United States Patent [19]

Ciallella et al.

[11] Patent Number: 4,806,261

[45] Date of Patent: Feb. 21, 1989

[54] DETERSIVE ARTICLE

[75] Inventors: Loretta K. Ciallella, Hopelawn; Charles Buda, Middlesex, both of N.J.

[73] Assignee: Colgate-Palmolive Co., Piscataway, N.J.

[21] Appl. No.: 179,608

[22] Filed: Apr. 11, 1988

[51] Int. Cl.[4] ..... C11D 17/00

[52] U.S. Cl. ..... 252/90; 252/135; 252/174; 252/174.12; 252/174.14; 252/174.21; 252/174.24; 252/174.25; 206/0.5

[58] Field of Search ..... 252/90, 174, 174.21, 252/135, 174.14, 174.24, 174.25, 174.12; 206/0.5

[56] References Cited

U.S. PATENT DOCUMENTS

| | | | |
|---|---|---|---|
| 3,322,674 | 5/1967 | Friedman | 252/90 |
| 4,348,293 | 9/1982 | Clarke et al. | 252/90 |
| 4,416,791 | 11/1983 | Hag | 252/90 |
| 4,608,187 | 8/1986 | Chang | 252/90 |

FOREIGN PATENT DOCUMENTS 944053 12/1963 United Kingdom .

*Primary Examiner*—Paul Lieberman
*Assistant Examiner*—Hoa Van Le
*Attorney, Agent, or Firm*—Bernard Lieberman; Murray M. Grill

[57] ABSTRACT

A detersive article, useful for charging an automatic washing machine with particulate built synthetic organic detergent composition, includes a detersive charge of such particulate composition in a closed container or packet which is formed by sealing about such composition a sheet or sheets of readily water dispersible water soluble cellulose compound and cellulose fibers, which is coated and/or covered or laminated with water soluble polyvinyl alcohol on interior surfaces thereof. The packet material dissolves or disperses rapidly when the packet is added to wash water in an automatic washing machine, and thereby releases contained detergent composition to the wash water earlier in the washing process than do other "dissolvable packets" which are made of polyvinyl alcohol. When a soil release promoting agent (SRP), such as PET-POET copolymer, is present in the particulate detergent composition superior soil release promotion is noted when washing polyester and polyester blend laundry, compared to washing such laundry with controls wherein the SRP is in a detergent composition that is not in a packet, or is in a composition in a PVA packet, without any CMC/cellulose sheet material being present.

11 Claims, 1 Drawing Sheet

DETERSIVE ARTICLE

Figure 1:
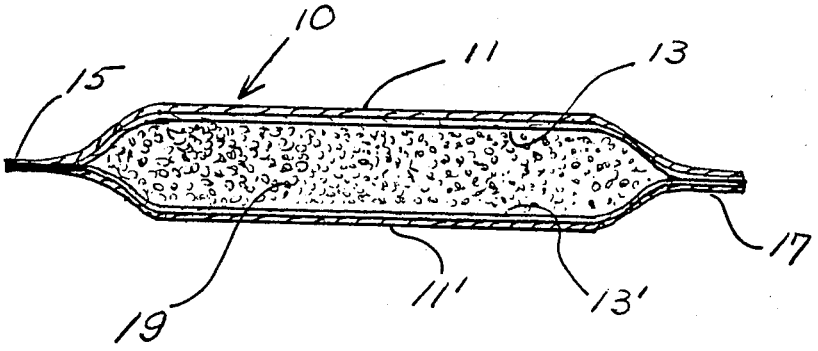

This invention relates to a detersive article, useful for washing laundry in automatic washing machines. More particularly, the invention is of an article that is comprised of a pre-measured particulate built synthetic organic detergent composition which is protected by being packed in a closed container which dissolves and/or disperses rapidly in wash water when it is added to such water in an automatic washing machine.

Particulate synthetic organic detergent compositions for use as heavy duty laundry detergents are well known and have been incorporated in envelopes or packets that are suitable for charging to the wash tub of an automatic washing machine. In some instances the detergent composition is dissolved by wash water which passes through the packet walls, and in other cases the packet opens when a portion of it dissolves in the wash water, allowing the detergent composition to leave the packet and dissolve. Various problems have been encountered with both such types of packeted detergent products, among which problems are slow dissolving of the detergent composition, sometimes leading to lumping of the particles together before they are released from the packet, and the presence of packet remnants on and in washed laundry. Also, in some cases the packet material does not satisfactorily contain the particulate detergent composition and allows escape of some of the composition, especially dustier particles of it, through the packet walls. Such negative characteristics have made various such packets unacceptable to consumers, and leaking containers are particularly objectionable because an important reason for a consumer to purchase packeted detergent compositions is that by use of them one is able to avoid touching the powdered detergent and can avoid any "detergent dusting" when the article is added to the wash water. Another fault of prior art packeted detergent powders has been deterioration of some container wall materials, such as polyvinyl alcohol, on storage, possibly due in part to dehydration of such material by the packet contents and/or by low relative humidity ambient air. Thus, water soluble polyvinyl alcohol, which has been employed as a packet wall and to prevent sifting of detergent powder through a permeable packet wall, can become less water soluble on storage, and sometimes even becomes brittle enough to crack from handling, causing leakage of contents. Even if the walls stay intact, so that the contents do not leak out through them, when the packet is charged to water in a washing machine the less soluble polymer inhibits quick dissolving and opening of the packet, thereby decreasing effective washing time and the time available for treatments of the laundry with other components of the detergent composition.

The various disadvantageous properties of prior art packeted particulate detergent compositions have been overcome by the present invention, and some significant and unexpectedly beneficial effects have been obtained. Thus, the packets do not leak contents before use and when added to wash water, whether hot or cold, the packets dissolve/disperse relatively quickly, usually leaving no fragments thereof on the washed laundry, and providing improved detersive effects and other treatments (such as soil removal promotion) over controls. The water soluble film-forming polyvinyl alcohol does not become insolubilized on storage and does not thereby impede release of the packet contents to the wash water. Additionally, some of the components of the packet are desirably functional to improve properties of the contained compositions vs. controls.

In accordance with the present invention a detersive article, for use in an automatic washing machine, for washing laundry, comprises a particulate built synthetic organic detergent composition in a closed container, the walls of which container are composed of a readily water dispersible sheet or film of water soluble cellulose compound, such as a carboxymethyl cellulose, and cellulose fibers, coated with a water soluble polyvinyl alcohol on interior surfaces thereof, which articles are of improved washing activity when added to wash water in an automatic washing machine, compared to control articles made with polyvinyl alcohol film container walls, due to more rapid breaking open thereof in the wash water and earlier discharging of the detergent composition contents into the wash water. In some preferred embodiments of the invention the synthetic organic detergent is a nonionic detergent, preferably of the narrow range ethoxylate (NRE) type, the builder is an inorganic water soluble salt, such as sodium tripolyphosphate, sodium carbonate, sodium silicate and/or sodium bicarbonate, or water insoluble ion exchanging material, such as zeolite, and the detergent composition contains a soil release promoting polyethylene terephthalate polyoxyethylene terephthalate (PET-POET) copolymer. Surprisingly, soil release promotion is found to be better for the invented packeted articles after normal or lengthy shelf storage, compared to control particulate detergent compositions that are not so packeted but which are similarly stored. A further advantage of the invention is that the exterior surfaces of the packeting material are capable of being printed in the same manner as paper and therefore do not require additional wrapping or labeling, although normally a plurality of the packets will be boxed together. Thus, legible trademarks, advertising, use instructions and other indicia may be printed directly on the packet material.

A search of the prior patent art, library research, and other inquiries have resulted in findings of various patents, non-patent prior art and other information relevant to the present invention. It appears that the most relevant patent is U.S. Pat. No. 4,348,293, which teaches the packing of a particulate detergent composition in a water insoluble, water permeable bag that has a water soluble or removable water insoluble layer on the inside thereof to protect the bag material from the particulate detergent composition, and to reduce dusting. The patent teaches that the bag material may be paper or a plastic material, such as polypropylene, and various water soluble materials mentioned include polyvinyl alcohol. Although this patent does teach lining a cellulosic material with polyvinyl alcohol and heat sealing the resulting packet about a particulate detergent composition the patented product is a different type of detersive article and does not suggest the present invention. The main difference between the reference product and that of this invention is that the reference product packet is a high wet strength paper which does not disintegrate in wash water, and therefore has to be removed from the laundry after completion of washing (or after subsequent drying). The container materials of the present articles dissolve and/or disperse readily in the wash water and so are removed from the laundry with the wash water, and do not have to be located and/or removed later. In the event that any fibers would remain with the washed laundry they will be readily removed by the drying air in an automatic laundry dryer, when the laundry is subjected to such drying.

Various other patents disclose or allude to packaging particulate detergent compositions in soluble or rupturable envelopes, some of which envelopes include polyvinyl alcohol and others of which include cellulosic materials or cellulose derivatives. U.S. Pat. No. 2,760,942 is for a water soluble envelope which includes a film of water soluble cellulose derivative and a film of water soluble polyvinyl alcohol composition. Other envelope patents which relate to polyvinyl alcohol compositions include U.S. Pat. Nos. 3,198,740; 3,374,195; 3,413,229; 3,892,905; 4,155,971; 4,340,491; 4,416,791; 4,608,187; and 4,626,372. U.S. Pat. No. 3,086,007 relates to a soluble cellulose derivative, sodium cellulose acetate propionate sulfate, as a water soluble film, which may be employed as a packaging material. British patent specification No. 2,090,603A discloses a polyvinyl alcohol polyacrylic acid water soluble film which is taught to be useful as a packaging agent.

Although polyvinyl alcohol has been suggested as a container or packet material for particulate packeted detergent compositions intended to be added in toto to wash water in an automatic washing machine tub, and although soluble cellulosic compounds have also been suggested as materials from which water soluble containers can be made, the packaging material of the present articles is significantly different from those discussed above. The material employed by applicants is sold by Gilbreth International Corporation, Bensalem Pa., as Dissolvo® Water Soluble Paper, under their designator, DP 45LC. Such material dissolves very quickly in the wash water (the cellulosic or wood fibers may not actually dissolve but they break up and are separated into such small fibers that they seem to dissolve). The manufacturer has suggested them for use as typing papers for classified documents because they are easily destroyed by wetting, if that should become necessary. They have also been suggested by the manufacturer for use as pouching materials for dry and powdered granular chemicals, dyes, fungicides, household detergents, bleaches, cleansers, etc. However, there is no manufacturer's bulletin or other publication known to applicants which describes any particulate detergent compositions like those of applicants, in dissolvable pouches or packets made from the materials described herein. Thus, it is considered that at best the above-reported suggestion in the Gilbreth International Corporation bulletin on Dissolvo is only an invitation to experiment. Certainly there is no disclosure therein of the desirable effect of the cellulosic portion of the film on the polyvinyl alcohol coating (inhibiting insolubilization thereof) and there is no indication that the packet material would improve detergency and increase the soil release promoting action of PET-POET copolymer in the contained particulate detergent composition, compared with a similarly treated control.

The invention will be readily understood by reference to the description thereof in the present specification, taken in conjunction with the drawing, in which:

FIG. 1 is a sectional view along a vertical plane, of a packet of this invention, positioned horizontally, showing the dissolvable paper external layers and the PVA internal laminate thereon, about the detergent composition contents.

Numerals 11 and 11' designate the cellulose carboxymethyl cellulose (CMC) paper, and numerals 13 and 13' indicate the PVA covering on such papers. Inside the packet 10, which is formed by heat sealing the paper-PVA sheets at peripheral portions or ends 15 and 17, is particulate detergent composition 19.

As is illustrated in the drawing, packet 10 is formed about detergent composition 19 by heat sealing the peripheral portions of the packet material about the contained detergent composition. Such is usually done by automatic machine when the paper-PVA sheets and resulting packets are still held together in a strip, and the packets can be separated subsequently by machine cutting across the strip at the heat sealed portions thereof.

The resulting packet may contain the desired weight of detergent composition, such as 20 to 100 grams per packet, with such weights including the weight of the envelope material too, most of which can be a functional part of the detergent composition. The preferred total weight for the packet is in the range of 30 to 50 grams, e.g., about 40 grams, which will be enough to charge about 0.06% of detergent composition to a 64 liter washing machine tub of water. Thus, for a 0.12% concentration of detergent, to be employed against especially heavily soiled laundry, one could employ two packets and when a smaller washing machine is used or less wash water is employed in the machine only one packet might be needed to obtain such higher concentration.

The paper/CMC base for the dissolvable packet material is one that is intentionally made of low web strength as by a manufacturing process in which an organic solvent is employed to treat the paper to reduce surface tension, after which the paper is dried at a relatively low temperature. Subsequently, the dry strength of the paper may be improved, without increasing its wet strength, by treating it with a remoisturizing bonding agent, such as carboxymethyl cellulose or lower alkyl cellulose, such as an alkyl cellulose. Processes for manufacturing such quick dissolving paper are described in Japanese Patent No. 48 99405 (application No. 47 33457) of Mishima Seishi, Ltd. Another method for making such a readily dissolvable paper is described in U.S. Pat. No. 3,431,166, assigned to Mishima Paper Manufacturing Co., Ltd.

To make their Dissolvo water soluble paper Gilbreth International Corporation coats the water soluble paper made by Mishima Seishi, Ltd. in the manner previously described, with polyvinyl alcohol on one side thereof. Such coating may be from an aqueous polyvinyl alcohol (PVA) solution or a film of PVA may be fused to the paper, or a combination of such procedures may be employed. The polyvinyl alcohol is heat sealable, which makes use of the resulting dissolvable paper especially advantageous in commercial packeting equipment, which forms, fills, seals and separates the packets, to which machine a strip of the dissolvable paper and the particulate detergent composition are appropriately fed, and from which filled and sealed packets are removed.

The components of the dissolvable paper may be those described in the mentioned Mishima patent insofar as the cellulosic materials are concerned. The cellulose fibers, wood pulp or wood fibers (the terms are used interchangeably) are processable on standard paper making equipment and may be made into packets (or other containers) by standard packet manufacturing (or other suitable) machines. In addition to employing carboxymethyl cellulose, usually as alkali metal carboxymethyl cellulose, e.g., sodium and potassium salts, which are the preferred remoisturizing agents, one may also utilize other water soluble cellulosic compounds, such as the lower alkyl celluloses, e.g., methyl, ethyl and propyl celluloses, and the hydroxy-lower alkyl celluloses, including hydroxpropyl cellulose and hydropropyl methyl cellulose. The polyvinyl alcohol employed may be in dilution, dispersion or film form, as is considered to be appropriate under the circumstances, and may be pure polyvinyl alcohol or a mixture thereof with some polyvinyl acetate, such as a 90:10 or 80:20 mixture, or other commerical product mixture, or the polyvinyl alcohol may be employed in mixture with other suitable water soluble polymer, such as polyacrylate, polyacrylamide, or acrylic maleic copolymer, in useful proportions, which may include from 50 to a 100% of the polyvinyl alcohol. Desirably, if other polymer is present with the polyvinyl alcohol such polymer will have a useful functional effect in conjunction with the detergent composition, preferably acting as a builder for the detergent, as a suspending agent for soil in the wash water, or as a polyelectrolyte, and acting with the polyvinyl alcohol film or coating to seal the container or packet, when it is dry, and being quickly dissolvable in wash water.

The particulate detergent composition which is contained in the described readily water dispersible packet material of the present articles may be any suitable built detergent composition (and sometimes the described envelopes may be employed to contain charges of other compositions intended for use in automatic washing machines, such as wash cycle additives, non-built detergents, fabric softening compositions, bleaching compositions, and other laundry treating products), but it will often be preferable for the contents of the packet to be a built nonionic detergent composition, especially one containing soil release promoting agent (SRP), such as PET-POET copolymer. Thus, while it is considered that various anionic detergents, such as the sulfated and sulfonated fatty alcohols and alkylbenzenes, wherein the alkyls are of 10 to 18 carbon atoms, may be employed as detergents, quaternary ammonium salts, such as dimethyl ditallowalkyl ammonium chloride, and bentonite may be employed as fabric softeners, and sodium perborate may be utilized as a bleaching agent, separately or in combinations thereof, with or without builders, in the described packeting material, built detergent compositions, such as built nonionic detergent compositions, will be preferred contents of the present packets. Descriptions of various nonionic detergents, anionic detergents, builders, fabric softening agents, bleaches, etc. may be found in the text *Surface Active Agents and Detergents,* Vol. II, by Schwartz, Perry and Berch, published by Interscience Publishers, Inc. in 1958, which is incorporated herein by reference.

The nonionic detergents of this invention include those described in the Schwartz et al. text, previously cited, but the nonionic detergents which are preferred components of the present built detergent compositions will be condensation products of higher alcohols or alkylphenols wherein the alkyl of the alkylphenol is of 7 to 10 carbon atoms and the alkyl of the higher alcohol is of 10 to 16 carbon atoms, preferably 12 to 15 carbon atoms and more preferably 12 to 14 carbon atoms. For the alkylphenol the alkyl is preferably of 8 or 9 carbon atoms and normally it will be preferred for at least 80% of the alkyls of both the alcohol (which is preferably linear and fatty, and more preferably linear and saturated) and the alkylphenol to be within the ranges of carbon atoms contents mentioned, although it is recognized that commercial alcohols and alkylphenols include alkyls which are distributed over ranges of contents of carbon atoms, due to the natures of the materials and due to the manufacturing methods employed. The nonionic detergents will include averages of 4 to 12 moles of ethylene oxide (EtO) per mole of higher fatty alcohol, preferably 5 to 10 moles of EtO per mole, and 1 to 30, preferably 2 to 15 EtO's per mole of the polyethoxy alkyl phenols. While broad range ethoxylates (BRE's) may be employed, it will be highly preferable to utilize narrow range ethoxylates (NRE's), in which at least 70% of the ethylene oxide content thereof is in polyethoxy groups of 4 to 12 ethylene oxides, and more preferably at least 85% of the ethoxy content is in groups of 5 to 10 ethoxies. As has been described in U.S. patent application Ser. No. 084,524, filed Aug. 10, 1987 by Holland et al., in the presence of PET-POET copolymer soil release promoting agent soil release promotion is unexpectedly improved by the presence of such NRE nonionic detergents. Furthermore, in preferred articles of the present invention soil release, compared to a control, after shelf storage, is surprisingly improved by the presence of the packet material. In the most preferred NRE nonionic detergents that are utilized in accordance with this invention, the average content of ethylene oxide will be about 6 or 7 moles of EtO per mole of nonionic detergent and at least 85% of the ethylene oxide will be in EtO chains of 5 to 10 moles of EtO, usually with more than half (and preferably more than 70%) being of 6 or 7 moles of EtO per mole. In the less preferred BRE nonionic detergents about 50% or less of the EtO groups will be in the 5 to 10 EtO/mole range.

Among the preferred NRE nonionic detergents employable in accordance with the present invention is Tergitol® Nonionic Surfactant 24-L-60N, which is of the formula $RO(CH_2CH_2O)_nH$, wherein R is a mixture of $C_{12}$ and $C_{14}$ linear alcohols and n averages about 7. Such product has a cloud point of 60° C. for a 1% aqueous solution. Its composition was described in a product information bulletin issued by the manufacturer, Union Carbide Corporation, which carries the date of April, 1987. In place of Tergitol Nonionic Surfactant 24-L-60N there may be also be employed similar products manufactured by Shell Chemical Company, which have been identified as Shell® 23-7P and Shell 23-7Z.

Various builders and combinations thereof which are effective to complement the washing action of the nonionic synthetic organic detergent(s) and to improve such action include both water soluble and water insoluble builders. Of the water soluble builders, both inorganic and organic builders may be useful, but the inorganics are preferred, usually as alkali metal salt(s). Among the water soluble inorganic builders those of preference include: various phosphates, usually polyphosphates, such as the tripolyphosphates and pyrophosphates, more specifically the sodium tripolyphosphates and sodium pyrophosphates, e.g., pentasodium tripolyphosphate, tetrasodium pyrophosphate; sodium carbonate; sodium bicarbonate; sodium silicate; sodium borate or borax; and mixtures thereof. Instead of a mixture of sodium carbonate and sodium bicarbonate, sodium sesquicarbonate will sometimes be substituted. The alkali metal or sodium silicate, when employed is normally of $M_2O:SiO_2$ or $Na_2O:SiO_2$ ratio within the range of 1:1.6 to 1:3, preferably 1:2.0 to 1:2.8, e.g., 1:2.4 or 1:2.35.

Of the water soluble inorganic builder salts, when phosphates are not environmentally objectionable they may be employed, sometimes with a lesser proportion of sodium silicate. In preferred non-phosphate compositions carbonates may be employed with bicarbonate, and sometimes with borate and/or a lesser proportion of sodium silicate. Silicates will rarely be used alone. Instead of individual polyphosphates being utilized it may sometimes be preferred to employ mixtures of sodium tripolyphosphate and sodium pyrophosphate. Of course, it is recognized that changes in phosphate chemical structure may occur during crutching and spray drying, when such manufacturing processes are used, so the final product may differ in phosphate content somewhat from the phosphate components charged to the crutcher, which are those set forth in the present description (but on a final product basis). Similarly, some bicarbonate (sometimes about ⅓ ) may be converted to carbonate, with release of carbon dioxide and water by spray drying. Although sometimes water soluble organic builders may be employed too, such as trisodium nitrilotriacetate (NTA), water soluble inorganic builders are generally preferred, as was previously indicated. The various water soluble builder salts may be utilized in hydrated forms, which are sometimes preferred, and the water soluble builders, hydrated or anhydrous, will normally be alkali metal salts or mixtures of alkali metal salts, but sodium salts are usually preferred. In some instances, as when neutral or slightly acidic detergent compositions are being produced, acid forms of the builders may be preferable but normally the salts will either be neutral or basic in nature, and usually a 1% aqueous solution of the detergent composition will be of a pH in the range of 9 to 11.5, e.g., 9 to 10.5.

Insoluble builders, generally of the Zeolite A type, usually hydrated, as with 15 to 25% of water of hydration, may be used advantageously in the compositions of the present invention. Hydrated Zeolites X and Y may be useful too, as may be naturally occurring zeolites and zeolite-like materials and other ion-exchanging insoluble compounds that can act as detergent builders. Of the various Zeolite A products, Zeolite 4A will often be preferred. Such materials are well known in the art and methods for their manufacture need not be described here. Usually such compounds will be of the formula $$(Na_2O)_x\cdot(Al_2O_3)_y\cdot(SiO_2)_z\cdot w\ H_2O,$$

wherein x is 1, y is from 0.8 to 1.2, preferably about 1, z is from 1.5 to 3.5, preferably 2 to 3 or about 2, and w is from 0 to 9, preferably 2.5 to 6.

The zeolite builder should be a univalent cation exchanging zeolite, i.e., it should be an aluminosilicate of a univalent cation such as sodium, potassium, lithium (when practicable) or other alkali metal, or ammonium. Preferably the univalent cation of the zeolite type mentioned is an alkali metal cation, especially sodium or potassium and most preferably it is sodium, as was indicated in the preceding formula. The zeolites, whether crystalline or amorphous, are capable of reacting sufficiently rapidly with calcium ions in hard water so that, alone or in conjunction with other water softening compounds in the detergent composition, they soften the wash water before adverse reactions of water hardness ions with other components of the synthetic organic detergent composition occur. The zeolites employed may be characterized as having a high exchange capacity for calcium ion, which is normally from about 200 to 400 or more milligram equivalents of calcium carbonate hardness per gram of the aluminosilicate, preferably 250 to 350 mg. eq./g., on an anhydrous zeolite basis. Also, they preferably reduce the hardness quickly in wash water, usually within the first 30 seconds to five minutes after being added to the wash water, and they can lower the hardness to less than a milligram of $CaCO_3$ per liter within such time. The hydrated zeolites will normally be of a moisture or water of hydration content in the range of 5 to 30%, preferably about 15 to 25%, and more preferably 17 to 22%, e.g., about 20%. The zeolites, as charged to a crutcher mix, from which base beads may be made, should be in finely divided state, with the ultimate particle diameters being upto 20 microns, e.g., 0.005 to 20 microns, preferably 0.01 to 8 microns mean particle size, e.g., 2 to 7 microns, if crystalline, and 0.01 to 0.1 micron, e.g., 0.01 to 0.05 micron, if amorphous. Although the ultimate particle sizes are much lower, usually the zeolite particles are of sizes within the range of No's. 100 to 400 sieves, preferably No's. 140 to 325 sieve, as charged to a crutcher for the manufacture of base beads.

PET-POET copolymers useful in the practice of the present invention are available from Alkaril Chemicals, Inc. in powder or aqueous dispersion form. Alkaril QCF is a powdered copolymer of this type and Alkaril QCJ is a 30% aqueous dispersion of it. Such polymers were of a molecular weight range of 19,000 to 25,000, e.g., about 22,000, but for the present articles a M.W. of about 25,000 is preferred. It is also preferred that the SRP be fused into particles with polyacrylate (PA) as in 4:1 ratios of SRP:PA with the SRP's being QCF or QCJ (dehydrated) and such products were available as Alkaril Base C and Alkaril Velvetol 251-C. Alkaril SRP II, which is now preferably used in the detergent compositions of the invented articles, is a fusion product of 19 parts of SRP of M.W. of about 25,000 and 1 part of Alcosperse 149 (which will be mentioned later). Alkaril SRP-2-15 is a 15% aqueous dispersion of that copolymer, without any polyacrylate. It has been found that less polyacrylate is needed to stabilize soil release promotion of the higher molecular weight PET-POET copolymer hence the 19:1 SRP:PA ratio instead of 4:1. The mentioned PET-POET copolymers are of molecular weights in the range of 19,000 to 43,000, more preferably about 19,000 to 30,000, e.g., about 25,000, according to molecular weight determinations performed on samples thereof which have been employed herein. However, it has recently been found that higher molecular weight polymers of weights up to 100,000 or 200,000, may also be useful in the present articles. The molecular weights are weight average molecular weights, as distinguished from number average molecular weights which, in the case of the present polymers, are often lower. In the polymers utilized the polyoxyethylene will often be of a molecular weight in the range of about 1,000 to 10,000, preferably about 2,500 to 5,000, more preferably 3,000 to 4,000, e.g., 3,400. In such polymers the molar ratio of polyethylene terephthalate to polyoxyethylene terephthalate units (considering

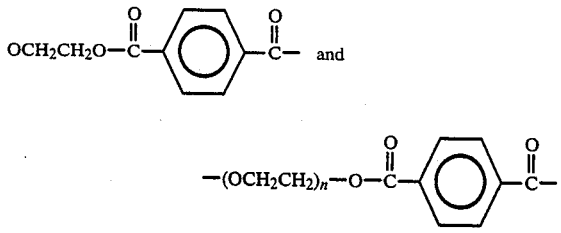

as such units) can be within the range of 2:1 to 6:1, preferably 5:2 to 5:1, more preferably 3:1 to 4:1, e.g., about 3:1. The proportion of ethylene oxide to phthalic moiety in the polymer is normally at least 10:1 and often will be 20:1 or more, preferably being within the range of 20:1 to 30:1, and often more preferably being about 22:1. Thus, it is seen that the polymer may be considered as being essentially a modified ethylene oxide polymer, with the phthalic moiety being only a relatively minor component thereof, whether calculated on a molar or weight basis. It is considered surprising that with such a relatively small proportion of ethylene terephthalate or polyethylene terephthalate in the copolymer, such copolymer is sufficiently similar to the polymer of polyester fibers (or other polymers to which it is adherent, such as polyamides) as to be retained thereon during washing, rinsing and drying operations.

Although the described PET-POET copolymers are those which are normally employed by applicants and are preferred, other PET-POET polymers, such as those described in U.S. Pat. No. 3,962,132 and in British Patent Specification No. 1,088,984 , can be employed and can be effective soil release promoting agents in the compositions and methods of this invention. However, the soil release promoting properties of such materials may not be as good as those of the preferred polymers.

Polyacrylates are preferably used to stabilize the PET-POET copolymer, and thereby increase its soil removing power after storage. The polyacrylates employed are of low molecular weight, such as alkali metal polyacrylate, e.g., sodium polyacrylate, the molecular weight of which is usually within the range of about 1,000 to 5,000, preferably being in the range of 1,000 to 3,000 and most preferably being between 1,000 and 2,000, e.g., about 1,500. The mean molecular weight will usually be within the range of 1,200 to 2,500, such as 1,300 to 1,700. Although other water soluble polyacrylates may sometimes be substituted in part for the described sodium polyacrylate, including some other alkali metal polyacrylates, e.g., potassium polyacrylate, it is preferred that such substitutions, when permitted, be limited to a minor proportion of the material, and preferably the polyacrylate employed will be an unsubstituted sodium polyacrylate. Such materials are available from Alco Chemical Corporation, under the name Alcospers ®. The sodium polyacrylates are available as clear amber liquids or powders, completely soluble in water, with the solutions being of about 25 to 40% solids contents, e.g., 30%, and with the pH of such solution or of a 30% aqueous solution of a corresponding powder being in the range of 7.0 to 9.5. Among these products those preferred are presently sold as Alcosperse 105, 107, 107D, 109, 149 and 149D, of which Alcosperse 149D, a 100% solids powder, is usually preferred, although Alcosperse 149, a 30% aqueous solution, may be used instead, with little difference in results (provided that it is dried before fusion with the SRP). Both are sodium polyacrylates, with the liquid (149) being of a pH in the 7.0 to 9.0 range and with the pH of the powder (149D) being in the 7.0 to 8.0 range, at 30% concentration in water. The powder is preferably anhydrous but may contain a minor proportion of water, normally less than 10%, which is largely removed during any fusion operation, such as takes place when the PET-POET copolymer and the polyacrylate are combined by being melted together and then cooled to solidification, as described in U.S. Pat. No. 4,571,305.

To make the stabilized soil release promoting polymer components of the packeted compositions, following normal procedure, the PET-POET polymer is melted by being raised to a temperature above its melting point, and preferably to a temperature in the range of 70° to 150° C., to liquefy it, and there is added to it powdered sodium polyacrylate. When a uniform melt has been obtained it may be cooled and the solidified mass may be size reduced by any suitable means. Preferably, cryogenic grinding or flaking operations will be employed and the product will be a finely divided powder or flake, which will be readily miscible with other particulate powder components of a built detergent composition and does not segregate objectionably from such composition. Alternatively, an appropriate melt may be spray cooled to desirably sized beads, which will usually pass through a No. 10 sieve (U.S. Sieve Series), and preferably will pass through a No. 30 sieve. Because the proportion of the polyacrylate is relatively minor (although its effect is significant) the PET-POET copolymer provides a medium for distributing the polyacrylate throughout any detergent composition with which it is mixed. Thus, in addition to the stabilizing effect the polyacrylate has on the PET-POET copolymer, the polymer helps to extend the polyacrylate so that it may be more uniformly distributed throughout any detergent composition and thereby may more uniformly impart to such composition desirable properties of the polyacrylate, which include promotion of clay soil removal from laundry during washing and inhibition of soil redeposition onto the laundry during washing. The "carrying" of the polyacrylate by the stabilized polymer also obviates the need to spray the detergent composition beads or base beads with a solution of polyacrylate to distribute it more evenly throughout the detergent composition, prior to packeting thereof.

The stabilized PET-POET copolymers, with the preferred polyacrylate stabilizer in intimate contact therewith, are employed in the present invention for soil release promotion in the described detergent compositions. It has been found that laundry, especially laundry in which the fabrics are of polyesters or polyester blends of fibers (often with cotton), more readily release various soils to the wash water during washing with built synthetic organic detergent compositions, especially those based on nonionic detergents, if the soiling of the laundry takes place after it has been washed with such a detergent composition containing the PET-POET copolymer. Some of the copolymer is held to the laundry during the washing operation, so that it is present thereon when the laundry is subsequently soiled, and its presence promotes the removal of such later applied soil and/or stain during a subsequent washing. It might have been expected that the polyacrylate, in the same particles as the PET-POET copolymer, would promote dispersion of the polymer and inhibit deposition thereof on the laundry, but such is not the case.

Instead, the polyacrylate increases the soil release promoting activity of the PET-POET polymer in detergent compositions. One mechanism accounting for this increase is the inhibition by the polyacrylate of decomposition or degradation of the polymer, especially at elevated temperatures, when it is subjected to contact with alkaline materials, as in built detergent compositions in which the builder salt is alkaline (as many of such are).

In addition to the NRE, builder and PET-POET copolymer, or in addition to the mentioned three components and polyacrylate stabilizer, the detergent compositions that are employed will usually also contain water (or moisture) and one or more adjuvants. A wide range of adjuvants may be employed, such as those which are normally present in detergent compositions of various types, but in the present compositions those adjuvants which are preferred include: enzymes, such as mixed proteolytic and amylolytic enzymes; fluorescent brighteners, such as stilbene brighteners; colorants, such as dyes and pigments; crutching aids, such as citric materials and magnesium sulfate; and perfumes. In some instances fabric softeners, such as bentonite, quaternary ammonium halides or amines, are employed and sometimes flow improving agents, which are often special clays, may be present. Bleaches, such as sodium perborate, and bleach activators may be included in the present compositions, often in larger proportions than are employed for other adjuvants. Sodium perborate bleaches are most useful in detergent compositions intended for hot water washing, unless they also include bleach activators. Finally, fillers, such as $Na_2SO_4$, may also be present, in proportions greater than normal for other adjuvants.

In the nonionic detergent compositions utilized there will normally be present 10 to 30 or 35% of the nonionic detergent, preferably 15 to 25% thereof and usually more preferably 18 to 22%, e.g., about 20%. The builder content (preferably inorganic builder content) will usually be within the range of 30 or 40 to 75 or 80%, preferably 50 to 70% and most preferably about 60 to 68%, e.g., 62% and 66%. The PET-POET soil release promoting copolymer will usually be 1 to 10% of the detergent composition present, preferably being 3 to 7% and more preferably about 4% thereof, with the sodium polyacrylate content being 0 to 5%, preferably 0.1 to 2% and more preferably about 0.1 to 1%. When, in the appended claims, certain adjuvants, such as polyacrylate, are not specifically recited, it should be considered that they may be present as part of the adjuvant content of the detergent composition. Thus, sodium polyacrylate, enzymes, sodium perborate and sodium sulfate are examples of such "adjuvants". When sodium sulfate and/or sodium perborate are present the total proportion of adjuvants in the detergent composition may be as high as 25%.

The water content of the detergent composition will normally be in the range of 1 to 20%, preferably being 5 to 12%, and more preferably, 6 to 11%, e.g., 7%, 10%. The adjuvant content, when such "adjuvants" are not specified, is usually in the range of 0 to 10%, preferably 1 to 5%, and more preferably, 1 to 3%, e.g., about 1% or about 2%.

The walls of the packet are made from a film or sheet of water soluble material and cellulose fibers, which is covered with water soluble polyvinyl alcohol on interior surfaces thereof. The water soluble material with the cellulose fibers is very preferably a water soluble cellulose compound, e.g., sodium carboxymethyl cellulose, which is a major proportion of the uncoated wall, compared to the minor proportion of cellulose fibers. The polyvinyl alcohol can be a relatively minor proportion of the packet wall, sometimes being as low as 4 % or even 1% thereof, but normally will be from 50 to 200% of the total of the cellulose fibers and carboxymethyl cellulose. On a total wall material basis, the packet will preferably be composed of 5 to 25% of cellulose fibers, 20 to 70% of alkali metal carboxymethyl cellulose (or other suitable water soluble polymer) and 20 to 70% of polyvinyl alcohol, with the ratio of cellulose fibers to alkali metal carboxymethyl cellulose or suitable soluble polymer being in the range of 1:6 to 1:2. Preferably, the packet will comprise 5 to 15% of cellulose fibers, 35 to 55% of sodium carboxymethyl cellulose and 30 to 60% of polyvinyl alcohol, and more preferably will be 8 to 13% of cellulose fibers, 40 to 50% of sodium carboxymethyl cellulose and 40 to 50% of polyvinyl alcohol, e.g., about 11% of cellulose fibers, about 44% of sodium carboxymethyl cellulose and about 45% of polyvinyl alcohol, all of which figures are on a dry basis. Such packet walls may contain some moisture but normally the percentage thereof will be low, usually being less than 10% and preferably being in the range of 1 to 5%.

The packet material will normally be 1 to 10% of the weight of the contained detergent composition, preferably 2 to 5% thereof, and more preferably about 4% thereof. The packet wall thickness will normally be in the range of 0.05 to 0.3 mm., preferably being 0.08 to 0.25 mm. and more preferably being in the range of 0.1 to 0.2 mm., e.g., about 0.15 mm. At such thicknesses the packet walls are strong enough to hold the particulate detergent composition without leaking it and without having the PVA film crack or rupture. Also, the PVA film does not become insolubilized on storage before use (the CMC and wood fibers help prevent that), and the film will still dissolve readily when the packet is added to the wash water in an automatic washing machine.

To manufacture the packet wall material, first the dissolvable paper of the previously mentioned Japanese patent is made by the method described therein and referred to earlier in this specification, employing proportions of cellulose or wood fibers and water soluble polymer (CMC), as previously specified herein. Then a coating of aqueous polyvinyl alcohol solution, such as one of a solids content in the range of 1 to 40%, is applied to the paper, by means of a nip roll, and is dried thereon, or a PVA film is held to the dissolvable paper by a bonding agent, such as a PVA solution, which is dried, and the resulting paper is calendered. The described method lends itself to continuously manufacturing the dissolvable packet material. The roll of coated paper resulting is cut into strips of appropriate width and such are fed to an automatic packaging machine, which inserts the particulate detergent composition contents between paper portions to be sealed together, closes such portions about the contents, and seals them, preferably by heat sealing (but glue sealing, cementing, solvent fusion, stitching and stapling are also feasible). The resulting strip of filled packets is separated, by cutting, into individual packets, and they are appropriately boxed and made ready for sale and use.

The detergent composition contents for the packets may be made in any suitable manner, most of which are commercially practiced. For example, one may spray dry a crutcher mix of stable components, absorb into such spray dried beads nonionic detergent at elevated temperature and in liquid state, and mix with such beads the PET-POET - polyacrylate particles, any heat sensitive components of the composition and various adjuvants that might be employed, including enzymes, perfumes and bleach, if any. Alternatively, the detergent composition may be a mixture of granulated or powdered components, an agglomerate, or a mixture of particulate materials made by different manufacturing methods. In fact, one of the advantages of the present invention is that an attractive product (the packeted detergent composition) can be made without the need for spray drying, size classification, or particle shape control, because the particulate product is not visible through the walls of the packet and even though some of the components thereof may be in very finely divided or even dusty form, none of such dust escapes from the packet.

While the employment of the dissolvable packet allows the use of mixed granulated components of the detergent composition, at the present time it is still preferred to spray dry base beads comprising inorganic builder(s) and minor heat stable components, followed by absorption of liquid state nonionic detergent into such spray dried builder beads, and blending the resulting particulate intermediate product with additional detergent composition components. Spray dried products tend to dissolve more readily in wash water than do corresponding crystalline granules, in many cases, and the presence of the nonionic detergent therein helps to lower the surface tension of the water immediately adjacent to the bead and thereby additionally promotes wetting thereof and quick dissolving. Also, the product often looks more familiar and better to the consumer, if the package is opened and the product is seen.

The spray drying to base beads is usually of an aqueous crutcher mix of 40 to 75% solids concentration by a spray nozzle in droplet forms into heated drying air at a temperature in the range of 250° to 450° C. (but of course the globule and particle temperatures do not exceed 100° C. at atmospheric pressure, so long as there is vaporizable water present in the globule or spray drying bead). Details of spray drying processes suitable for use in making detergent compositions employable in the present invention are found in U.S. patent application Ser. No. 084,524, previously mentioned herein, and such patent application also discloses the manufacture of the final detergent composition of the present articles that is contained in the described packets. See U.S. Pat. No. 4,569,772, for a more detailed description of the manufacture of the stabilized PET-POET copolymer, and see Ser. No. 084,524 and U.S. Pat. No. 4,571,303 for descriptions of methods of testing resulting detergent compositions (and articles) for cleaning and soil release promoting activities.

To manufacture the invented articles the described particulate detergent composition is made by spray drying a crutcher mix to base beads of inorganic water soluble builder salt or of a mixture of water soluble builder salt and water insoluble builder, to produce a comparatively high density bead, which is of a bulk density greater than 0.5 g./cc., preferably 0.6 or 0.7 to 1.0 g./cc., and of particle sizes in the range of No's. 4 to 120 sieves or 4 to 140 sieves, preferably in the 10 to 100 sieves range, which particle size ranges may be obtained by screening processes. The nonionic detergent component is heated to an elevated temperature, such as 40° to 60° C., at which it is in liquid state, and is sprayed onto and absorbed by the base beads, after which other components of the composition may be blended with such nonionic detergent - builder beads. For the solid constituents it is preferred that they be of a particle size range like that of the base beads, and the liquid components are preferably sprayed onto the surfaces of the beads, by which they are absorbed. Colorant solution and perfume are normally added to the product near the end of the manufacturing procedure, and any flow improving agent, such as magnesium silicate, may also be added at such stage or later (usually in very finely divided form, such as No. 325 sieve)

The Dissolvo paper, obtained in rolls from Gilbreth International Corporation, which is of a width of about 18 cm. (although various widths, from 5 cm. to 20 or 30 cm. may be employed), is mounted on an automatic packeting machine and the detergent composition, in particulate form, is charged to the feed hopper of such machine. Then, the packeting material and detergent composition particles are simultaneously fed through the machine, with the desired proportion of particles being entrapped between the dissolvable paper sheets for each packet, and the packet is automatically heat sealed. As illustrated in the drawing, sealings are on all four sides of the packet (or two sides and two ends) but a double width strip may be employed, folded in half and sealed on three sides (with the other side not requiring sealing), which may be preferred in some cases. The completed packets, cut apart, or perforated so as to be in severable strip form, are boxed and ready for use. If desired, before boxing or cartoning the packets may be inserted in reclosable polyethylene or other suitable pouches, preferably of the press-resealable type. One or more of the packets may be in such protective pouch. In a variation of the procedure described the dissolvable paper will be printed with indicia, such as article identification, trademarks, manufacturer's name and/or instructions for use of the article, with any cautions that consumer protection agency regulations might require (although none are required because of the packaging). Printing is normally done before the paper is cut into strips, to be rolled up in rolls suitable for use in the packeting machine. Because the paper is cellulosic in nature it readily takes printing on the cellulosic side thereof. Preferably, the printing ink will be dissolvable in wash water so as not to interfere with the dissolving of the packet and its content. In some cases, the ink will include a bluing material and a fluorescent dye, which may desirably modify the appearance of the indica and also will be functional with respect to whitening and/or brightening washed laundry.

Tests of the articles made in accordance with the invention establish that the packets are sufficiently strong to retain the contents thereof in normal use, and even when subjected to abnormally difficult conditions. Thus, the packet can be dropped on the floor without breaking and can be stored for comparatively long times, up to a year, without the PVA becoming water insoluble. The polyvinyl alcohol coating, whether applied as a solution or as a previously produced film (which may be laminated to the cellulosic sheet with a dilute aqueous PVA solution, preferably of 1 to 5 or 10% concentration) satisfactorily seals in the contents of the packet and helps to protect components of the composition subject to hydrolysis and oxidation. Surprisingly, the invented packets win dispersibility tests against control packets of the polyvinyl alcohol film only, whether tested in gentle, permanent press or normal washing machine cycles, in cold water or in warm water. In such tests, a test packet or a control packet is placed in the washing machine tub, on top of the wash water only or on top of laundry to be washed, too, agitation is begun and the time is recorded when the pouch breaks open and detergent contents enter the wash water. By such testing, on average, the control packets took more than 50% longer to "dissolve" than the invented articles. Similar results, although not quite to the same extent, were observed when the test and control pacekts were both subjected to accelerated agings, by being stored for two weeks at a temperature of 43° C.

In other comparative tests, articles of the present invention were compared to controls for soil release promotion, in which tests the same particulate detergent compositions were employed but for the controls were packed in polyvinyl alcohol film only. After the packets had been stored for two weeks at 43° C. and under 80% relative humidity, the invented articles were found to be significantly better in soil release promotion with respect to all types of polyester materials tested, including double knit, single knit and woven polyester, and 65:35 polyester:cotton blends. Also, the articles are superior in soil release promotion, compared to the detergent composition alone, without any envelope material, when they are tested in the same manner.

With respect to improved soil release promotions compared to controls it has been theorized that the CMC, cellulose and PVA in combination, help to protect the SRP from hydrolysis on storage, and thereby decrease any loss of soil release promoting activity on storage, but the mechanism for such action has not been established.

The reason for improved dispersibility for the invented articles, compared to the polyvinyl alcohol packeted control articles, has not been definitely established. The result, which is considered to be surprising, might be due to the "paper" on the exterior of the polyvinyl alcohol film or coating protecting the polyvinyl alcohol from oxidation, further polymerization and/or hydrolysis but such has not been previously suggested so far as applicants are aware. The "dissolving" paper might also help pull the PVA film apart.

To use the invented articles the consumer needs only to add the required or desired number of them to the washing machine, instead of measuring out detergent powder from a carton. Usually the packet is added to the water before the laundry (to expedite dissolving), but alternatively, the wash tub of the machine may first be filled with water, after which the laundry to be washed may be added, and the packet of detergent may be added last, preferably while the agitator is operating. There is no need to open a packet before addition to the wash water because it will dissolve and open very quickly on its own. The relatively minor proportion of cellulosic fibers added to the wash water in which the packet dissolves does not result in any undesirable depositions on the laundry during normal washing and such fibers are readily removed from the washing machine during the pumping out of the wash water and removal of the rinse water, or by automatic drying when they exit the dryer with the drying air. If a few fibers still remain after completion of washing (as can happen in extreme cases, as when cold water and gentle cycle are employed, and the laundry is dried on a wash line), these will usually be hardly noticeable, even on laundry of dark or contrasting colors. Close examinations of washed laundry have rarely revealed any depositing of visible (to the naked eye) cellulose fibers (or PVA) thereon.

The invented articles allow the consumer to utilize pre-measured particulate detergent compositions to ensure that the right concentration of such a composition is being employed, and to avoid the need for measuring detergent powder, which sometimes involves subjecting oneself to breathing of dusty air resulting from pouring the powder from a box into a measuring cup. A major deficiency of various packeted particulate detergent compositions has been overcome by the present articles because such articles are quick to dissolve and disperse in wash water in an automatic washing machine, even when that water is cold and the wash cycle is gentle. Thus, substantially all of the washing cycle is utilized, while some other packeted products are only effective washing agents for lesser portions (sometimes less than half) of the wash cycle. The invented articles therefore wash better than various other packeted detergent compositions and, when soil release promoting agent is present in the compositions, better soil release is obtained with the present articles than with controls. Additionally, the packets are attractive, take printing readily, and are strong enough to withstand normal handling without breaking open before added to the wash water.

The following examples illustrate but do not limit the invention. Unless otherwise indicated, all parts in these examples, the specification and the claims are by weight and all temperatures are in °C.

EXAMPLE 1

| Component | Percent |
|---|---|
| Sodium tripolyphosphate | 57.3 |
| *Narrow range ethoxylated higher fatty alcohol | 20.0 |
| Water | 10.0 |
| Sodium silicate ($Na_2O:SiO_2$ = 1:2.35) | 4.5 |
| **PET-POET copolymer | 3.6 |
| Mixed proteolytic and amylolytic enzymes (Maxatase ® MP) | 1.3 |
| Sodium sulfate | 1.1 |
| Fluorescent brightener (Tinopal ® 5BM Extra Concentrated) | 1.0 |
| Sodium polyacrylate (Alcosperse ® 149D) | 0.9 |
| Colorant (dye mixture) | 0.1 |
| Perfume | 0.2 |
| | 100.0 |

*Condensation product of $C_{12-14}$ linear alcohol and an average of 6 to 7 moles of ethylene oxide per mole of alcohol, with about 88% of the ethylene oxide being in polyoxyethylene groups of 5 to 10 EtO's (Tergitol ® 24-L-60N, mfd. by Union Carbide Corp.)

**PET-POET copolymer of weight average molecular weight of about 22,000, with molecular weight of the polyoxyethylene being about 3,400 and molar ratio of polyethylene terephthalate to polyoxyethylene terephthalate units being about 3:1 (Alkaril ® QCF, mfd. by Alkaril Chemicals, Inc., and supplied by them in particulate form, in 4:1 ratio, with sodium polyacrylate, as pre-fused Alkaril Base C.)

A particulate detergent composition of the above formula is made by crutching a 45% solids crutcher mix of the tripolyphosphate, silicate, sulfate, fluorescent brightener and colorant, in tap water, at a temperature of about 60° C. and spray drying it into hot drying gas at a temperature of about 400° C. in a spray tower to form beads of sizes in the range of No's. 10 to 100, U.S. Sieve Series, having a moisture content of 13.5%. After cooling, 74 parts of such base beads are sprayed with 20 parts of the NRE nonionic detergent, in liquid state at elevated temperature, e.g., about 40° C., which detergent is absorbed into the beads. Then, 4.5 parts of a 4:1 Alkaril QCF/Alcosperse blend (in particulate form, of approximately the same particle size as the spray dried beads) and 1.3 parts of the enzyme mixture are mixed with the builder-nonionic detergent beads and subsequently the product is perfumed with 0.2 part of liquid perfume being sprayed thereon, during all of which operations the materials are maintained in motion in an inclined drum mixer.

A roll of Dissolvo DP 45LC dissolvable paper packeting material, weighing about 83 grams per square meter and of a thickness of 0.15 mm., of which about 0.09 mm. is of a CMC-cellulose fiber sheet and 0.06 mm. is a polyvinyl alcohol film, which sheet and film are laminated together by means of a dilute aqueous solution of polyvinyl alcohol (2%), and a particulate detergent composition, of particle sizes in the No's. 10 to 100 sieve range, and of a bulk density of about 0.6 g./cc., are both charged to an automatic packeting machine (Bartelt Flexible Packet Packager) which automatically forms 9×10 cm. packets of the type illustrated in the drawing or equivalent packets sealed on three sides and folded over on the other side, at a rate of 40 per minute, heat sealing all four (or 3) sides thereof and separating the strip of packets resulting by cutting across the heat seals between them. When only three sides are sealed the packets may be made from a double width (18 or 20 cm. wide) roll of Dissolvo DP 45LC, using a packeting machine that automatically packages the particulate detergent but which folds one side of the packet (to a width of 9 or 10 cm.) and heat seals the other three sides, before separating the packets. In both such embodiments of the invention the packets are of unprinted, plain white "paper" but in a improved embodiment indicia are printed on the package, including a trade name )MAGIC TM Detergent), manufacturer's name (applicants' assignee company) and use instructions. The ink employed is conventional water soluble printing ink but in a further improvement of the invention it is a fluorescent blue dye, which has both whitening and brightening properties on washed laundry.

When one 40 gram (contents) 9 cm.×10 cm. packet (packet material weight of 1.5 g.) is charged to a 64 liter capacity wash tub of medium hardness water (150 p.p.m., as $CaCO_3$) at 20° C. and is then employed to machine wash a mixed load of polyester/cotton blend laundry items (not heavily soiled), very satisfactory cleaning is obtained, using the machine's normal laundry cycle. No residue of cellulose fibers is found on the laundry after washing and none is apparent after drying in an automatic laundry dryer. When the same items are worn, re-soiled and re-washed even better soil removal (measured by reflectometer) is obtained, apparently due to effective depositing on the previously washed laundry of PET-POET soil release promoter.

The invented articles are compared to control articles in which the same particulate detergent composition is packaged in the PVA film only. In such tests 64 liters of water at desired temperature and hardness (150 p.p.m., as $CaCO_3$) and three pounds of laundry are added to an automatic washing machine, after which the packet being tested is placed on top of the water and agitation is begun. The elasped time between the beginning of agitation and the breaking open of the pouch and discharge of the detergent composition to the wash water is recorded and such times are compared. In the tests run, washing temperatures of 10° C. and 38° C. are used and gentle (six minutes), permanent press (10 minutes), and normal (10 minutes) wash cycles are employed. As expected, the shortest dispersibility times are observed with more vigorous agitation and at higher temperatures. On the average, the control articles take about 50% more than the invented articles to disperse, with the greater such time differences being for permanent press and normal agitation at low temperature (10° C.). In another comparative test, simulating agings of the packets, both the control and invented articles were subjected to heating for two weeks at 43° C. and then were tested for dispersibility, employing wash water at 150 p.p.m., as $CaCO_3$, and at 10° C., with a gentle washing machine cycle. In such test the control showed an increase of 38% in dispersing time, compared to a newly produced unheated control article, whereas the invented article increased only 17%. This "accelerated aging test" indicates that the invented articles maintain their capability of satisfactorily dispersing in the wash water for significantly longer periods than do the controls made with PVA film only, evidencing that the cellulose fiber-CMC paper not only adds strength to the PVA film of the packet but also improves dispersibility after storage, as well as immediately after production.

The described invented and control articles were further tested for soil release properties before and after rapid aging at 43° C. and 80% relative himidity. In such tests, swatches of different polyester weaves and of a 65:35 polyester: cotton blend were pre-washed once, using either the "experimental" or "control" article, and were dried, stained with dirty motor oil and aged overnight, after which they were re-washed once, using the same product as before. Washings were in Whirlpool 2000 automatic washing machines containing 64 liters of 49° C. water of 150 p.p.m. hardness, as $CaCO_3$, and the ten minute normal washing cycle was utilized. The product concentration in the wash water is 0.06%, resulting from employing one packet per wash. After such testing it was found that the control lost about 200% more of its soil releasing power than did the invented article when polyester double knit was the test fabric and it lost over 300% more of such soil releasing power when polyester single knit was the fabric tested. For woven polyester the control lost about 100% more and for the polyester/cotton blend it lost over 100% more. Such tests indicate that under laundry room storage conditions (wherein high humidity may be encountered) soil release promoting activity of the invented articles will be significantly better than for the controls and deteriorations of the invented articles with respect to soil release promoting properties thereof will be significantly less, meaning that they will have much longer useful shelf lives.

EXAMPLE 2

| Component | Percent |
|---|---|
| Sodium zeolite | 27.7 |
| Sodium carbonate | 26.6 |
| *Narrow range ethoxylated higher fatty alcohol | 20.0 |
| Sodium bicarbonate | 11.0 |
| Water | 7.1 |
| *PET-POET copolymer | 4.0 |
| Sodium polyacrylate (Alcosperse (149D) | 1.0 |
| Enzymes (Maxatase MP) | 1.3 |
| Fluorescent brightener (Tinopal 5BM Extra Concentrated) | 1.0 |
| Colorant (dye mixture) | 0.1 |
| Perfume | 0.2 |
| | 100.0 |

*See Example 1
**See Example 1

The product of the described formula, a non-phosphate "FRESH®" type of particulate built synthetic organic nonionic detergent composition, is made in essentially the same way as the particulate detergent composition of Example 1, with a few relatively minor exceptions. The crutcher mix contains 45% of solids and such include the zeolite, sodium carbonate, sodium bicarbonate, fluorescent brightener, colorant and water. The spray drying conditions are the same except for the fact that some bicarbonate is converted to carbonate in the spray drying operation, so that the crutcher mix will often include some additional bicarbonate (and correspondingly less carbonate), to allow for such conversion. For example, when one-third of the bicarbonate is decomposed to carbonate, carbon dioxide and water, the initial bicarbonate content can be about 16.5% and the initial sodium carbonate content of the crutcher mix can be about 22.5%. After completion of spray drying the spray dried beads, which will have particle sizes in the No's. 10 to 100 sieves range and will be of a bulk density of about 0.6 or 0.7 g./cc., will be of a moisture content of about 10.7%. The liquid state nonionic detergent is absorbed into the base beads in the same manner previously described and the melt of SRP and polyacrylate, the enzymes and the perfume are admixed with the base-nonionic detergent beads to produce the detergent composition for packaging in the Dissolvo packets, which are of the same material described in Example 1 and elsewhere in this specification, and are of the same size.

When the invented articles made are tested for detergency, dispersibility and soil releasing properties in the same manner as described in Example 1 the results are substantially the same, showing that such embodiment of the invention is also superior to a corresponding control.

EXAMPLE 3

The experiments of Examples 1 and 2 are repeated but instead of the 5% and 4.5% of the PET-POET copolymers and polyacrylates, in 4:1 proportion, there are employed 3.4% of Alkaril SRP II, which is a fused particulate product which comprises 19 parts of PET-POET copolymer of M.W. of about 25,000 (or 30,000) and 1 part of Alcosperse 149D. When tested against controls the products yield essentially the same desirable resuts as were reported for the products of Examples 1 and 2, and cleaning is better, apparently because the higher M.W. SRP is a more effective soil release promoter.

EXAMPLE 4

The experiments of Examples 1–3 are repeated but the soil release promoters and polyacrylates are separately admixed with the builder beads which had absorbed the liquid nonionic detergent, and the particulate detergent composition resulting is packed in the same Dissolvo packets. Detergency and dispersibility are essentially the same as for the corresponding products of the previous examples but soil release promoting activities are somewhat less (although less of such activity, percentagewise, is lost than for the controls).

In other modifications of Examples 1–3 the soil release promoters and polyacrylates are omitted, in which case their soil release promoting activities and stabilizing functions are lost, but the detergencies and dispersibilities of the articles made are superior to their controls, as with the corresponding articles of Examples 1–3.

In further modifications of the previous examples different builders are employed, such as those mentioned in the preceding specification, and proportions thereof are varied, within the ranges previously specified. For example, such variations in proportions may be ±10%, ±20% and ±30% of the percentages given in the working example, so long as such varied percentages are still within the ranges given in the specification. The products made possess the desired detergency and dispersibility and those which include SRP will also be soil release promoting, especially if polyacrylate is also present (more preferably fused with the SRP) and will be more stable than their corresponding controls when stored under hot humid conditions.

In still more embodiments of this invention the Dissolvo-type packeting material may be of different thicknesses, within the range specified and may be sealed by described methods other than heat sealing. In such cases, the desirable results mentioned above will also be obtained.

One can employ the described packeting material for packaging other particulate water soluble/dispersible items meant to be dissolved/dispersed in water, such as powdered bleaches, wash cycle additives, fabric softeners, bubble baths, floor and wall cleaners, and disinfectants, providing that they do not react adversely with the materials of the packet (strong oxidizing, reducing and hydrolyzing agents may thusly adversely react). However, a special feature of the present invention is that desirable comparative improvement on storage is obtained (so that the product shelf life is significantly extended) when the PET-POET copolymer is present in the particulate detergent composition, preferably with polyacrylate, in solidified melt form, and packeted as described.

The invention has been described with respect to examples and illustrations thereof but is not to be limited to these because it is evident that one having access to the present specification will be able to utilize substitutes and equivalents without departing from it.

What is claimed is:

1. A detersive article, for use in an automatic washing machine, for washing laundry, which comprises a particulate built synthetic organic detergent composition in a closed container, the walls of which container are composed of a readily water dispersible sheet or film of water soluble cellulose compound and cellulose fibers, covered with a water soluble polyvinyl alcohol on interior surfaces thereof.

2. A detersive article according to claim 1 wherein the particulate detergent composition comprises synthetic organic detergent, builder for the detergent, and soil release promoter, and the container is in the form of a packet, the walls of which are of a sheet or sheets of cellulose fibers and water soluble cellulose compound, covered and/or coated on insides thereof with polyvinyl alcohol, which detersive article is of improved washing activity, when added to wash water in an automatic washing machine, compared to a control article in which the container walls are of polyvinyl alcohol film, due to more rapid breaking open thereof in the wash water and earlier discharging of the detergent composition into the wash water than is obtained by use of such control.

3. A detersive article according to claim 2 wherein the walls of the packet are composed of a minor proportion of cellulose fibers and a major proportion of water soluble carboxymethyl cellulose, interiorly covered and/or coated with from 50 to 200% thereof of polyvinyl alcohol.

4. A detersive article according to claim 3 wherein the detergent composition is a built nonionic detergent composition which comprises a soil release promoting proportion of a soil release promoting polyethylene terephthalate polyoxyethylene terephthalate (PET-POET) copolymer, the water soluble carboxymethyl cellulose is an alkali metal carboxymethyl cellulose, and the walls of the packet are composed of 5 to 25% of cellulose fibers, 20 to 70% of alkali metal carboxymethyl cellulose, and 20 to 70% of polyvinyl alcohol, with the ratio of cellulose fibers to alkali metal carboxymethyl cellulose being in the range of 1:6 to 1:2.

5. A detersive article according to claim 4 wherein the detergent composition comprises 10 to 30% of nonionic detergent, which is a condensation product of one mole of fatty $C_{12-15}$ alcohol and 4 to 12 moles of ethylene oxide, 40 to 80% of inorganic builder for the nonionic detergent, 1 to 10% of PET-POET soil release promoting copolymer, 1 to 20% of water, and 0 to 10% of adjuvants, the packet comprises 5 to 15% of cellulose fibers, 35 to 55% of sodium carboxymethyl cellulose, and 30 to 60% of polyvinyl alcohol, and the packet is from 1 to 10% of the weight of the contained detergent composition.

6. A detersive article according to claim 5 wherein the detergent composition comprises 15 to 25% of nonionic detergent, which is a narrow range ethoxylate (NRE) condensation product of one mole of fatty $C_{12-14}$ alcohol and 5 to 10 moles of ethylene oxide, 50 to 70% of inorganic builder for the detergent, which builder is selected from the group consisting of sodium tripolyphosphate, water softening zeolite, sodium carbonate, sodium bicarbonate and sodium silicate, 3 to 7% of PET-POET copolymer of molecular weight in the range of 19,000 to 100,000, 0.1 to 2% of sodium polyacrylate of molecular weight in the range of 1,000 to 5,000, 5 to 12% of water and 1 to 5% of adjuvants, the packet consists of 8 to 13% of cellulose fibers, 40 to 50% of sodium carboxymethyl cellulose and 40 to 50% of polyvinyl alcohol, the packet is from 2 to 5% of the weight of the contained detergent composition, and the packet is heat sealed so as to contain the detergent composition therein, with the polyvinyl alcohol preventing sifting out of the contents and with the cellulose/-sodium carboxymethyl cellulose sheet or film preventing the polyvinyl alcohol from becoming water insoluble during storage.

7. A detersive article according to claim 6 wherein the detergent composition comprises about 20% of NRE nonionic detergent condensation product of one mole of fatty, saturated $C_{12-14}$ alcohol and 5 to 10 moles of ethylene oxide, about 57% of sodium tripolyphosphate, about 5% of sodium silicate, about 4% of PET-POET copolymer of molecular weight in the range of 19,000 to 43,000, about 1% of sodium polyacrylate of molecular weight in the range of 1,000 to 3,000, about 1% of enzyme, about 1% of sodium sulfate, about 1% of adjuvants and about 10% of water, the packet consists of about 11% of cellulose fibers, about 44% of sodium carboxymethyl cellulose and about 45% of polyvinyl alcohol, the weight of the packet is about 4% of the weight of the detergent composition and the packet thickness is about 0.15 mm.

8. A detersive article according to claim 6 wherein the detergent composition comprises about 20% of NRE nonionic detergent condensation product of one mole of fatty, saturated $C_{12-14}$ alcohol and 5 to 10 moles of ethylene oxide, about 28% of zeolite builder for the nonionic detergent, about 27% of sodium carbonate, about 11% of sodium bicarbonate, about 4% of PET-POET copolymer of molecular weight in the range of 19,000 to 43,000, about 1% of sodium polyacrylate of molecular weight in the range of 1,000 to 3,000, about 1% of enzymes, about 1% of adjuvants and about 7% of water, the packet consists of about 11% of cellulose fibers, about 44% of sodium carboxymethyl cellulose and about 45% of polyvinyl alcohol, the weight of the packet is about 4% of the weight of the detergent composition and the packet thickness is about 0.15 mm.

9. A detersive article according to claim 1 which includes at least one indicium printed on an outer surface of the article, which surface is comprised of cellulose fibers and water soluble cellulose compound, which indicium is an identification of the article, a trademark for the article, a manufacturer's name or instructions for use of the article.

10. A process of washing soiled laundry which comprises washing it in an automatic washing machine in wash water of a hardness in the range of 25 to 300 p.p.m., as calcium carbonate, at a temperature in the range of 5° to 50° C. and at a concentration in the range of 0.05 to 0.20%, with an article or articles of claim 1.

11. A process of washing soiled laundry which comprises washing it in an automatic washing machine in wash water of a hardness in the range of 25 to 200 p.p.m. of mixed calcium and magnesium hardness, as calcium carbonate, at a temperature in the range of 5° to 50° C. and at a concentration in the range of 0.05 to 0.20%, with an article or articles of claim 6.

* * * * *